US005321464A

United States Patent [19]

Jessen et al.

[11] Patent Number: 5,321,464

[45] Date of Patent: Jun. 14, 1994

[54] JAM-FREE CONTINUOUS-FORMS PRINTER

[75] Inventors: Robert F. Jessen, Endwell; Christopher A. Mertens; Nathan J. Olsen, both of Endicott; Robert J. Telfer, Vestal, all of N.Y.

[73] Assignee: International Business Machines Corporation, Armonk, N.Y.

[21] Appl. No.: 938,182

[22] Filed: Aug. 31, 1992

[51] Int. Cl.[5] ..... G03B 27/48; G03B 27/50

[52] U.S. Cl. ..... 355/50; 270/41; 355/48; 355/75; 493/410

[58] Field of Search ..... 355/50, 51, 47, 48, 355/75; 493/410, 10; 270/40, 41

[56] References Cited

U.S. PATENT DOCUMENTS

| | | | |
|---|---|---|---|
| 3,342,390 | 9/1967 | Winterbottom et al. | 493/410 X |
| 3,735,975 | 5/1973 | Sukel et al. | 270/61 F |
| 4,025,187 | 5/1977 | Taylor et al. | 355/14 |
| 4,030,720 | 6/1977 | Jones | 270/61 |
| 4,087,172 | 5/1978 | Van Dongen | 355/50 X |
| 4,213,601 | 7/1980 | Cattorini et al. | 270/61 |
| 4,227,683 | 10/1980 | Spangler et al. | 270/61 |
| 4,264,200 | 4/1981 | Tickner et al. | 355/75 |
| 4,300,710 | 11/1981 | Du Bois et al. | 355/75 X |
| 4,313,672 | 2/1982 | Schroeder, II et al. | 355/75 X |
| 4,334,764 | 6/1982 | Rawson et al. | 355/75 X |
| 4,469,320 | 9/1984 | Wenthe, Jr. | 271/98 |
| 4,486,093 | 12/1984 | McNew | 355/29 |
| 4,494,948 | 1/1985 | Teyssier, Jr. | 493/11 |
| 4,504,051 | 3/1985 | Bittner et al. | 270/40 |
| 4,597,748 | 7/1986 | Wolf | 493/29 |
| 4,714,946 | 12/1987 | Bajgert et al. | 355/75 |
| 4,716,286 | 12/1987 | Taylor | 250/214 |
| 4,734,744 | 3/1988 | Yamamoto | 355/3 |
| 4,810,239 | 3/1989 | Moss | 493/10 |
| 4,878,085 | 10/1989 | Ward et al. | 355/47 |
| 5,081,487 | 1/1992 | Hoyer et al. | 355/75 |

*Primary Examiner*—Richard A. Wintercorn
*Attorney, Agent, or Firm*—Michael E. Belk

[57] ABSTRACT

Tractor drives of a high speed printer move a length of continuous-form paper longitudinally up from a box of fanfold stacked paper, through a print mechanism, across paper directing means, and downward to refold onto a fanfold stack. A misfold detector is positioned at the paper directing means to sense the jumble of paper caused by misfolding prior to jamming of paper movement through the tractor drive to prevent damage to the paper, complex restarting procedures, or data loss.

6 Claims, 8 Drawing Sheets

JAM-FREE CONTINUOUS-FORMS PRINTER

TECHNICAL FIELD

This invention relates to high speed continuous-forms printing and, in particular, to misfold detection to prevent jamming during refold stacking of the continuous-forms subsequent to printing.

RELATED APPLICATIONS

Co-pending application Ser. No. 07/924,136 entitled "High Speed Continuous Forms Printer", incorporated herein by reference, discloses one or more upper chains and one or more lower chains to sweep against the refolding output stack at different times during different ranges of stack height.

Co-pending application Ser. No. 07/938,183 entitled "Misfold-Free Continuous-Forms Printer", incorporated herein by reference, discloses paper misfold detector for the output stack area.

BACKGROUND OF THE INVENTION

Information handling systems utilize high speed printers for rapidly generating printed information in a tangible form. High speed printers generally utilize xerographic or impact printing technologies. Impact printers are desirable for low cost and required where the option to print multipart forms is desired. The printing mechanism for impact printers generally transfer ink or other material from a print ribbon onto the paper to form images on one major surface of the paper.

Continuous-form paper is usually supplied from a box in which the paper is stacked in a fan-fold pattern. The paper may be single layer or may be multi-layer to provide multi-part forms. Continuous-from paper is perforated along lateral lines for dividing the continuous length into separable rectangular sheets or forms. Each of the separable sheets is rectangular and is typically 11.5 inches high by 14 and $\frac{7}{8}$ inches wide. The paper is folded along the perforations in a zigzag manner reminiscent of oriental hand fans in which each lateral perforation is folded in the opposite direction from the preceding fold to form a stack.

Tractor drives engage a longitudinal row of holes along each edge of the paper for moving the paper longitudinally from the source box of paper, through the printing mechanism and downward toward a horizontal surface upon which it refolds into an output stack of printed, continuous forms. The tractor drives tend to distort the paper at the tractor holes in the edges of the paper so the refold stack is bowed upward at the edges. Typically, the paper length remains slightly folded along the lateral perforations after unstacking and printing and the descending paper length naturally tends to refold onto the stack at each lateral perforation in the same direction that it was originally folded.

Since the introduction of fanfold paper refolding, practitioners have faced the problem that occasionally the paper will fail to refold along the lateral perforations in the proper direction, eventually a jumble of output builds up resulting in tearing of the sprocket holes as the tractors drive the paper against the jumble resulting in jamming of paper movement through the tractor drives. It is known that the misfolding is related to the bowing of the stack due to the tractor damage and to the height of the paper discharge above the top of the stack and is also related to the intermittent characteristics of feeding of the paper through the printer.

The longitudinal movement of the paper through the printer is not continuous. Usually the movement is stopped as each line is printed on the sheets. Also, the paper tends to move quickly through blank lines and even more quickly, through blank pages. For a very high speed paper tractor, the paper output is often accelerated so that descending paper bends as it falls into the stack and fails to properly refold onto the stack.

Also, the printer may not operate continuously. The output typically consists of separate reports which are transmitted to the printer as desired so that the printer is idle for minutes or even for hours between jobs. In addition, information handling systems tend to be idle for long periods due to schedules of working shifts, weekends and holidays. The paper in the printer may be idle with a lateral perforation in a straightened configuration so as to forget the original fold direction at the perforation; or the paper may be idle in a bent configuration and retain the bend so that it does not properly refold onto the output stack.

Once the stack is started in the proper location with the continuous length of paper refolding in the previous fan-fold directions, proper refolding tends to continue without any additional aid. However, occasionally the paper fails to refold in the desired direction which produces an unfolded jumble of printed output, and eventually applies forces to the paper moving through the tractor. The tractor tears out the sprocket holes in the paper causing the paper to stop moving through the printer.

In order to minimize data loss due to paper jamming practitioners have instituted jam detection schemes. For example, the rotation of a follower wheel in contact with the longitudinally moving length of paper can be compared with the movement of the tractor drives to detect jams.

U.S. Pat. No. 4,810,239 to Moss, incorporated herein by reference, discloses a misfolding paper detector. "When a jam causes a portion of the paper forms to be forced upwardly from the stack, that portion urges the interposing member upwardly also to block the projected beam and disable the printer." U.S. Pat. No. 4,030,720 discloses "a photo-electric switch . . . to detect the paper." U.S. Pat. Nos. 4,227,683 to Spangler et al. and 4,504,051 to Bittner et al. disclose optically sensing the height of a stack of fanfold paper to control an elevator which vertically positions the stack.

In unrelated arts optical means are used to sense jams. For example, U.S. Pat. No. 4,734,744 to Yamamoto which relates to copy machines, "the jam is detected if the [light] beam is not obstructed at regular intervals" and U.S. Pat. No. 4,716,286 to Taylor, which relates to money dispensing, discloses "sensors provided at spaced intervals along the common acceleration device determine if bills have reached the acceleration device . . . the adaptive technique compensates for changes in the sensor such as component aging and dust accumulation."

SUMMARY OF THE INVENTION

Accordingly, it is an object of this invention to provide a high speed continuous-forms printer which detects misfolding in the printed output refolding area prior to resulting jamming of paper movement through the printing mechanism.

It is another object to provide a process for reliably and economically operating a high speed continuous-forms printer without any loss of data resulting from occasional misfolding in the printed output refolding area leading to jamming of paper movement through the tractors.

It is another object of this invention to provide a high speed continuous forms printer adopted for using a misfold detector in the printed output refolding area to prevent jamming of paper movement through the printing mechanism and resulting loss of data.

It is finally an object of this invention to provide a detector adopted for converting an existing high speed continuous forms printer to the printer of this invention which detects misfolding prior to jamming of paper movement through the printing mechanism and resulting data loss.

In the applicant's invention the tractor drives of a high speed printer move a length of continuous-form paper longitudinally up from a box of fanfold stacked paper, through a print mechanism, through the tractor drives, across paper directing means, and downward for refolding onto a fanfold stack. Occasionally the refolding length of paper misfolds and the misfolding paper accumulates in a jumble between the tractor drives and paper directing means or between the paper directing means and the output paper stack. A paper misfold detector is provided at the paper directing means to detect any tangle of misfolding paper either above the stack or between the tractor drives and paper directing means.

Other features and advantages of this invention will become apparent from the following detailed description of the presently preferred embodiment and alternative embodiments of the invention, taken in conjunction with the accompanying drawings.

DETAILED DESCRIPTION OF THE DRAWINGS

Figure 1:
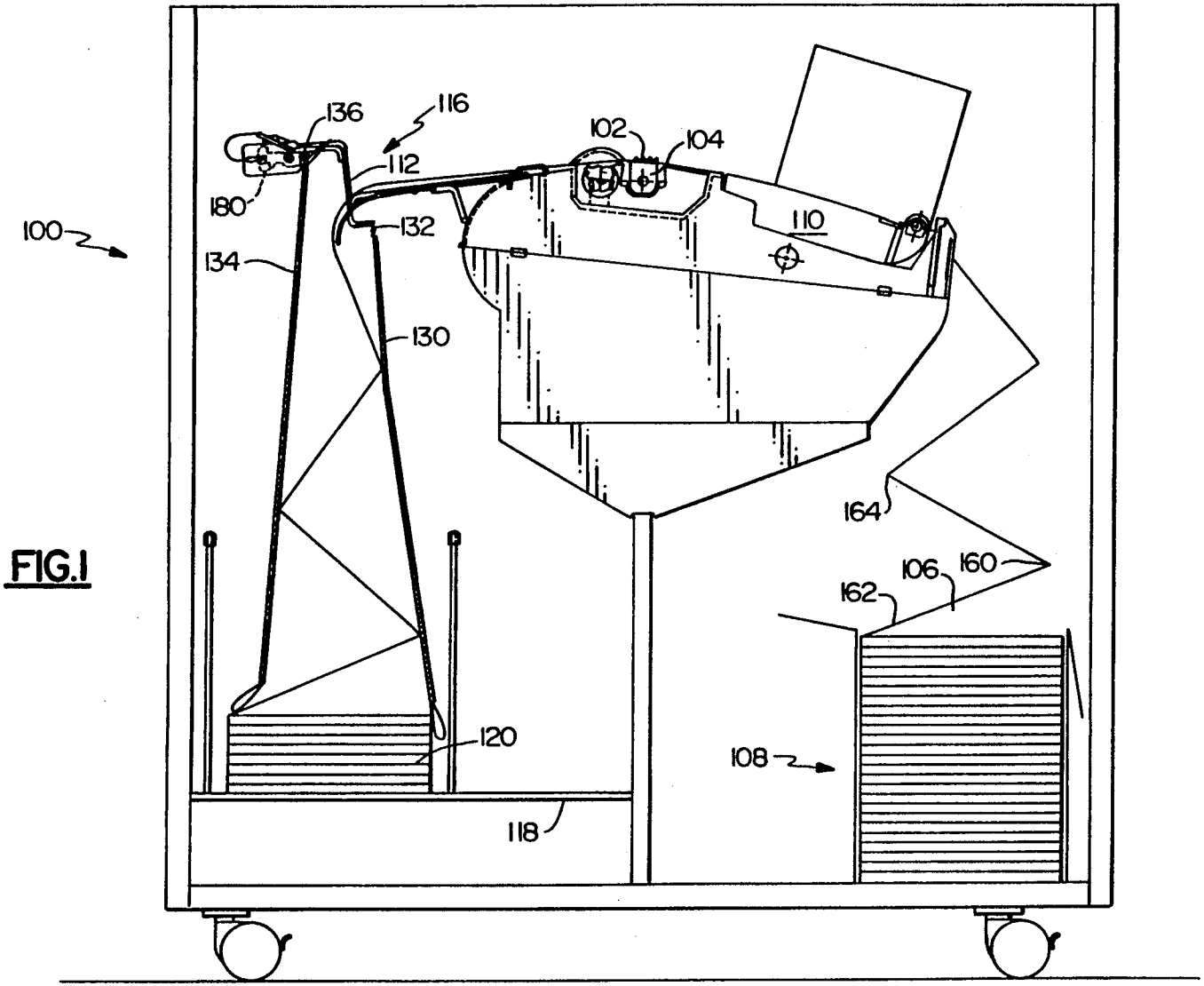
FIG. 1 schematically illustrates a side view of the printer of this invention with a misfold detector positioned at paper directing means to detect jumbling of paper either between the tractor and paper detecting means or between the detection means and the stack.

FIG. 1 shows printer 100 of the invention. Pins 102 of tractor drives 104 engage into sprocket holes (not shown) along each longitudinal edge of a continuous-form length 106 of paper, to move the continuous paper longitudinally from a source 108 of fanfold paper, through printing mechanism 110, through paper directing means 112 and downward at 116 toward generally horizontal surface 118 onto which the paper refolds onto output stack 120 in the same fanfold pattern as in the source. A set of chains 130 on the front side of the length 106 of paper hang vertically down from printer frame member 132; and similarly a set of chains 134 on the back side of the paper hang from printer frame member 136. The chains usually comprise hollow metal beads on a string or wire, or small interlocking links or any similar elongated member which does not catch the paper. The sets of chains interact with the folding length of paper.

Source 108 of paper may be, for example, a cardboard box containing a paper stack folded at perforations. The pattern of the folds is similar to the pattern used in hand held oriental fans in which each fold 160 is bent, as shown, in the opposite direction in relation to previous fold 162 and subsequent fold 164.

Misfold detector 180 is positioned at the paper directing means 116 to detect the jumble of paper accumulating either above or below the paper directing means as a result of misfolding.

The printer of the invention may be provided using an optional kit to convert an existing printer to the printer of the invention. The kit includes the misfold detector of the invention and means for mounting the misfold detector switch in position to detect both misfolds between the tractor drive unit and the paper directing means and misfolds between the paper directing switch and the stack. Also the kit would contain means for signal communication between the misfold detector and the existing printer to operate tractor drives 104 depending on a signal from the paper misfold detector for stopping of printing when misfolds are detected.

Figure 2:
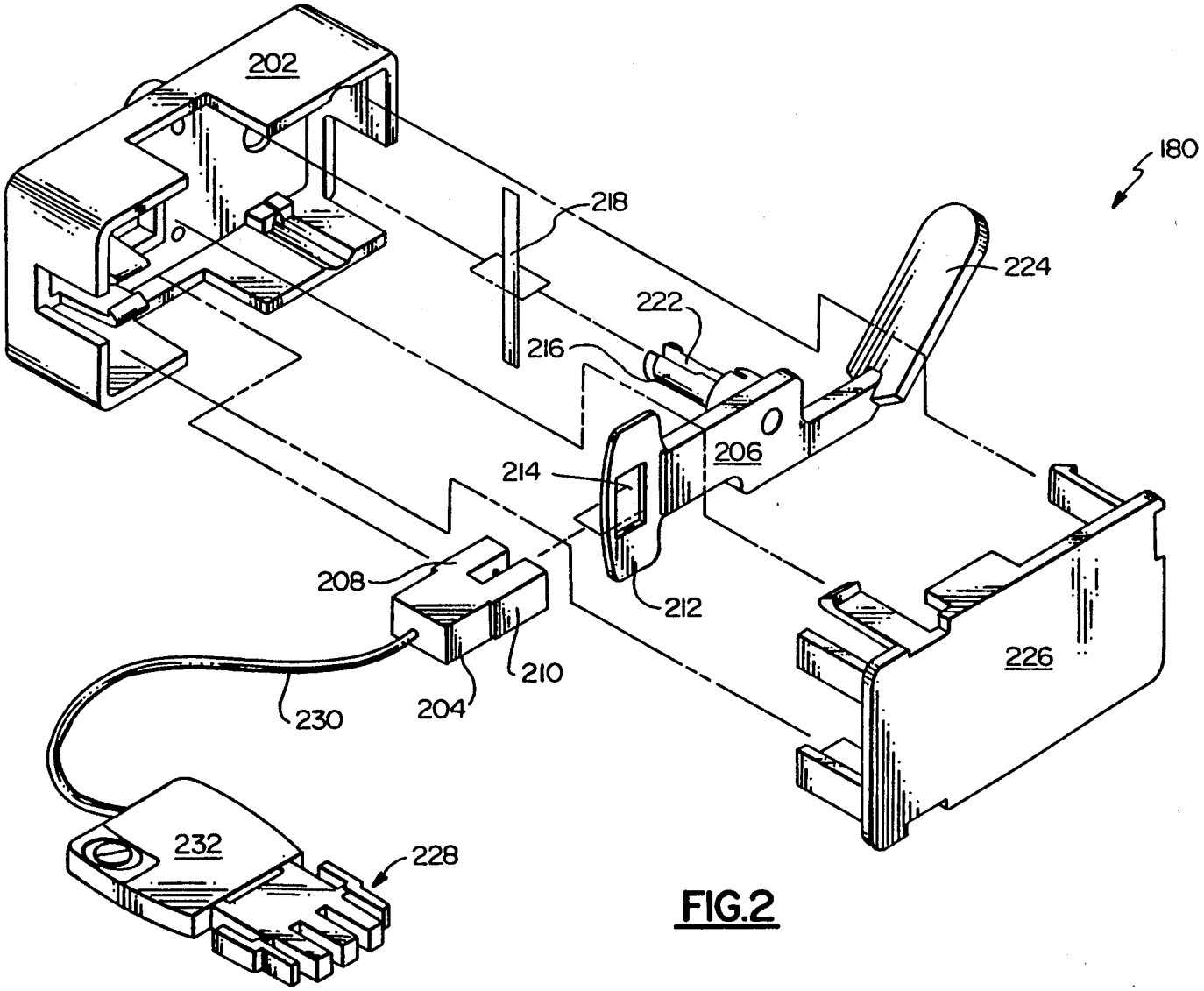
FIG. 2 is an isometric exploded view of the misfold detector of FIG. 1.

FIG. 2 shows misfold detector 180. Within base 202 is positioned opaque sensor 204 and optic plate 206. Sensor 204 includes an emitter leg 208 and a detector leg 210. One end 212 of plate 206 is positioned between emitter leg 208 and detector leg. End 212 contains transparent window 214 through which a light beam (not shown) from the emitter leg is directed to the detection leg when the window is positioned between the legs. The plate is attached to axle 216 which inserts through a hole in the base to allow plate 206 to rock about the axle. Bar spring 218 is inserted into split 222 in axle 216 to bias the plate in neutral position with the window between the two legs of the sensor. Lever 224 extends from plate 206 and any misfolding paper pushes on the lever to bend spring 218 and rock plate 206 so that the light beam is interrupted by the end 212 of plate 206 and the misfolding is detected. Base 202 limits the motion of plate 206 to protect spring 218 from excessive strain. Cover 226 snaps into position over base 202 in concert with base 202 protects the parts of the detector. Plug 228 is connected to the printer so that a signal indicating misfolding can be delivered through cable 230 to the printer to stop printing. Cable 230 is preferably a 4 conductor cable and plug 228 is preferably a 4 circuit in-line panel mount such as identified on page 8 of Catalog 87-803—Streamlined 8-88 for Soft-Shell Pin and Socket Connectors by AMP Incorporated of Harrisburg, Pa. herein referred to as AMP Catalog 87-803. Preferably strain relief 212 is provided to prevent damage to the connection between the cable and the plug such as shown at page 10 in AMP Catalog 87-803.

Figure 3:
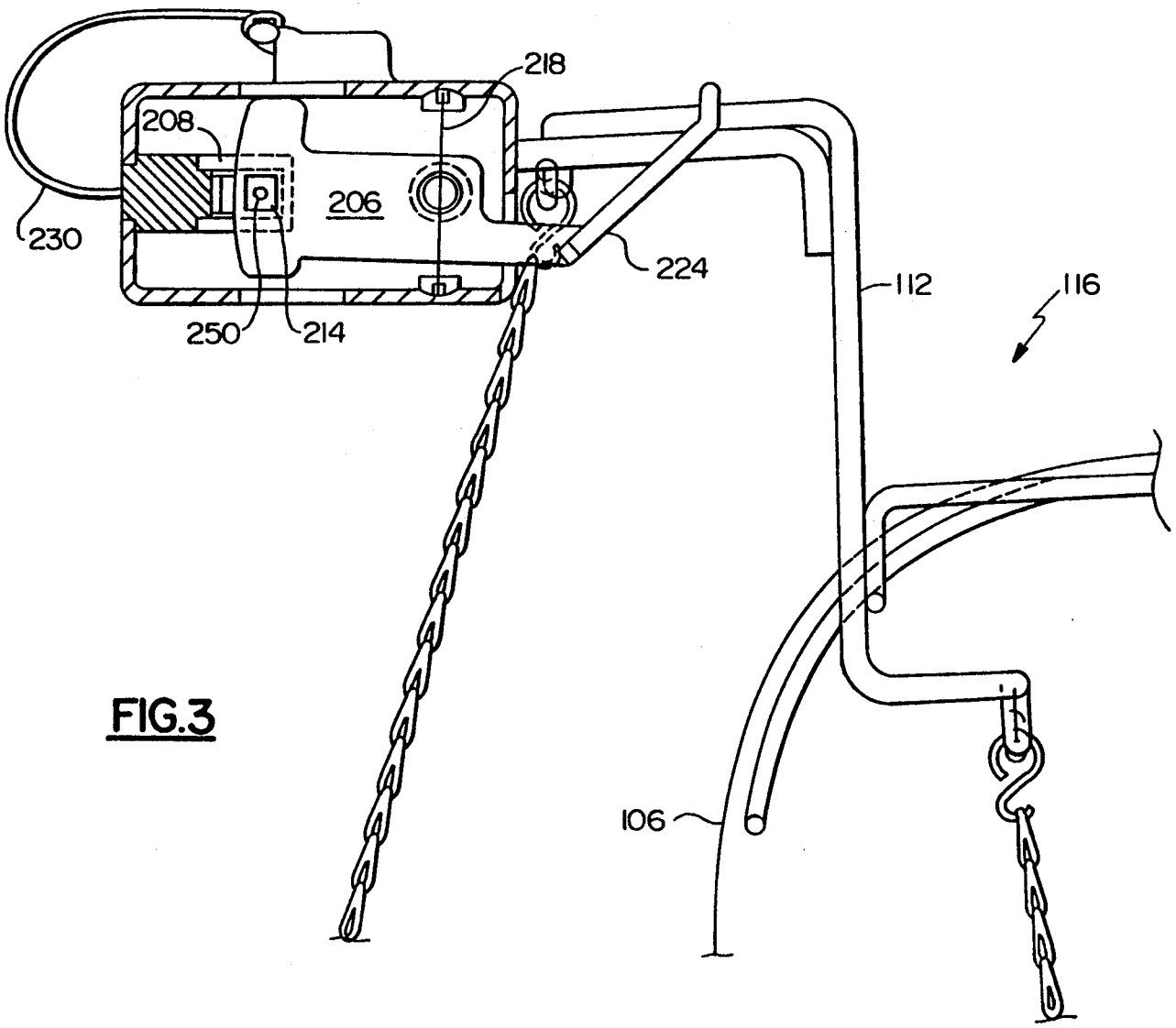
FIG. 3 shows a partial section of the misfold detector and the paper directing means of the printer of FIG. 1 with the paper normally moving longitudinally through the paper directing means without misfolding.

FIG. 3 shows the moving length of paper 106 traveling over paper directing means 116 and pulled downward by gravity toward the output paper stack 120 (see FIG. 1). The paper doesn't touch lever 224 and thus spring 218 biases window 214 in position for beam 250 directed from emitter leg 208 to travel through plate 206.

Figure 4:
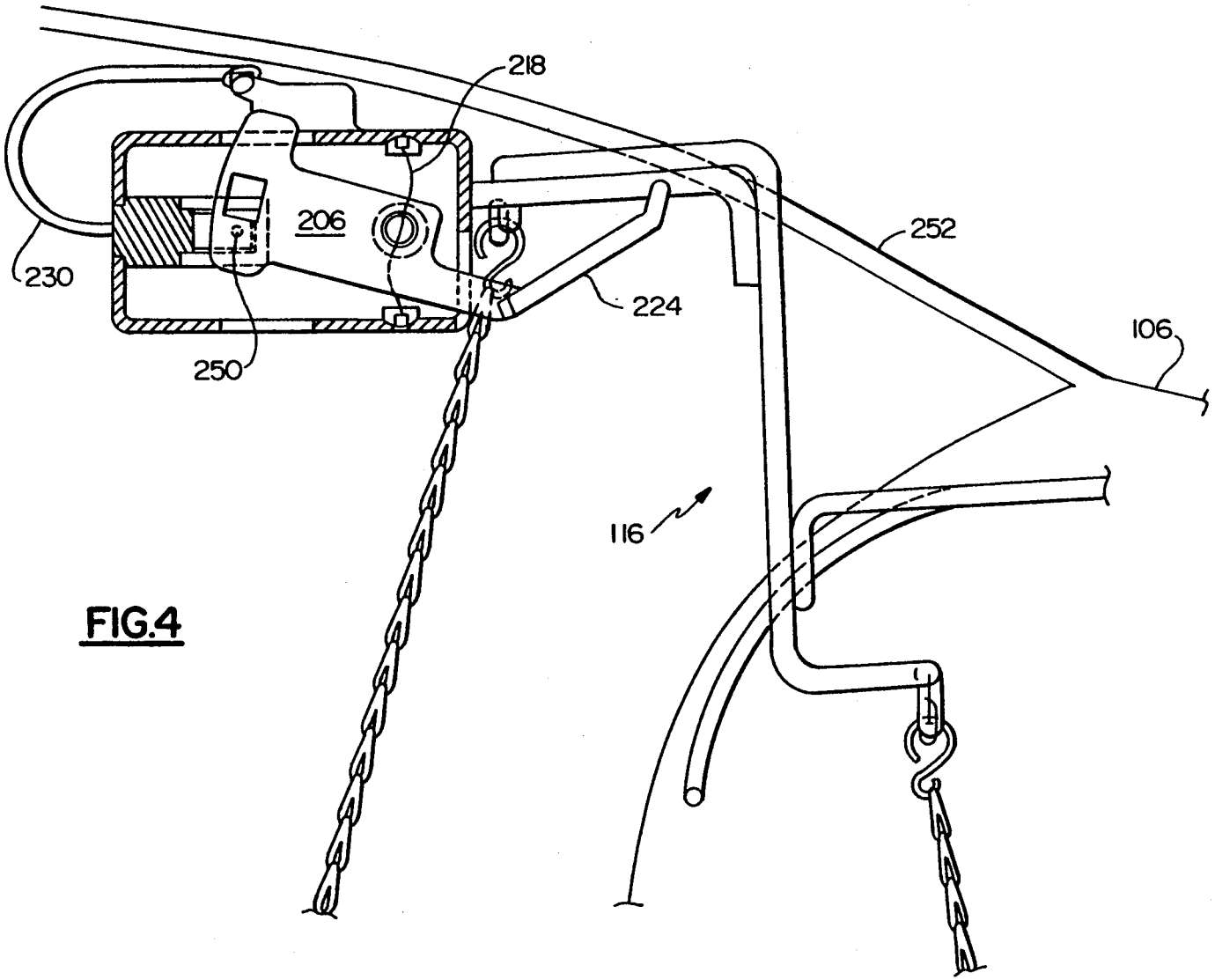
FIG. 4 shows a partial section of the misfold detector and the paper directing means of the printer of FIG. 1 with misfolding paper above the stack activating the misfold detector.

Figure 4 is similar to FIG. 3 except that misfold 252 of length 106 of moving paper between tractor drives 104 (see FIG. 1) and paper directing means 112, pushes down on lever 224 bending spring 218 and rocking plate 206 so beam 250, shown in phantom, is obstructed. The detector will generate a signal in cable 230 indicating misfolding and printing will be stopped.

Figure 5:
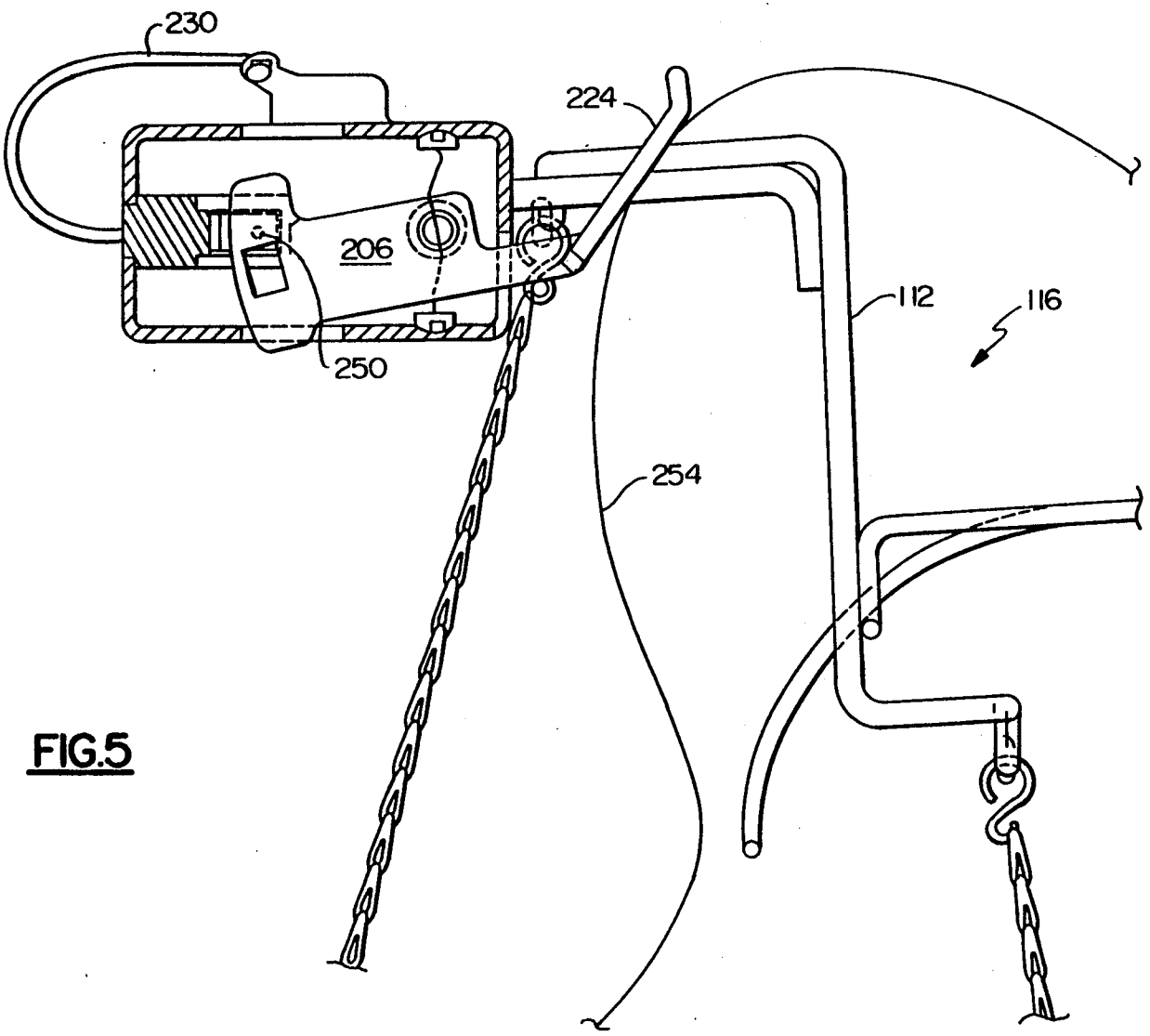
FIG. 5 shows a partial section of the misfold detector and the paper directing means of the printer of FIG. 1 with misfolding paper between the tractor drives and the paper directing means activating the misfold detector.

Figure 5 is similar to FIG. 3 except the misfold 254 is between paper directing means 112 and printed output paper stack 120 (see FIG. 1). Paper misfold 254 pushes upward on detector lever 224, obstructing beam 250 and resulting in a signal output through cable 230 indicating misfolding.

Figure 6:
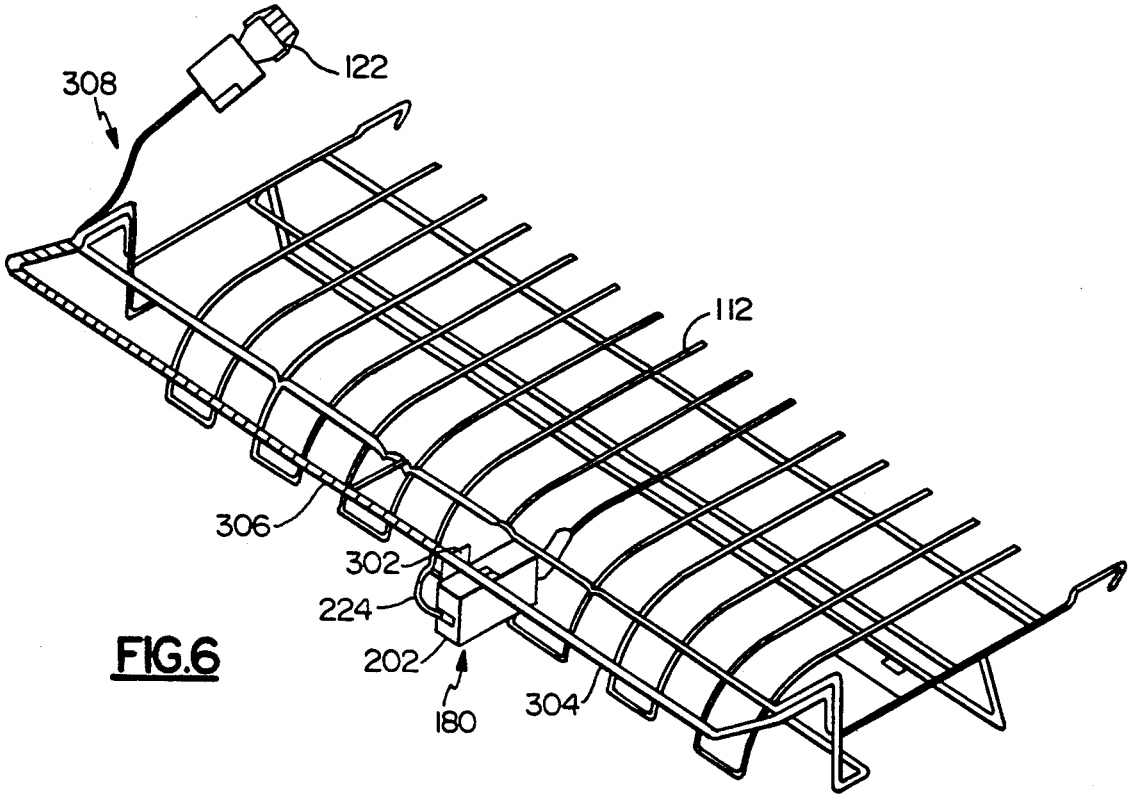
FIG. 6 is an isometric view showing the misfold detector positioned on the paper directing means of the invention and the plug for connection to the printer.
Figure 7:
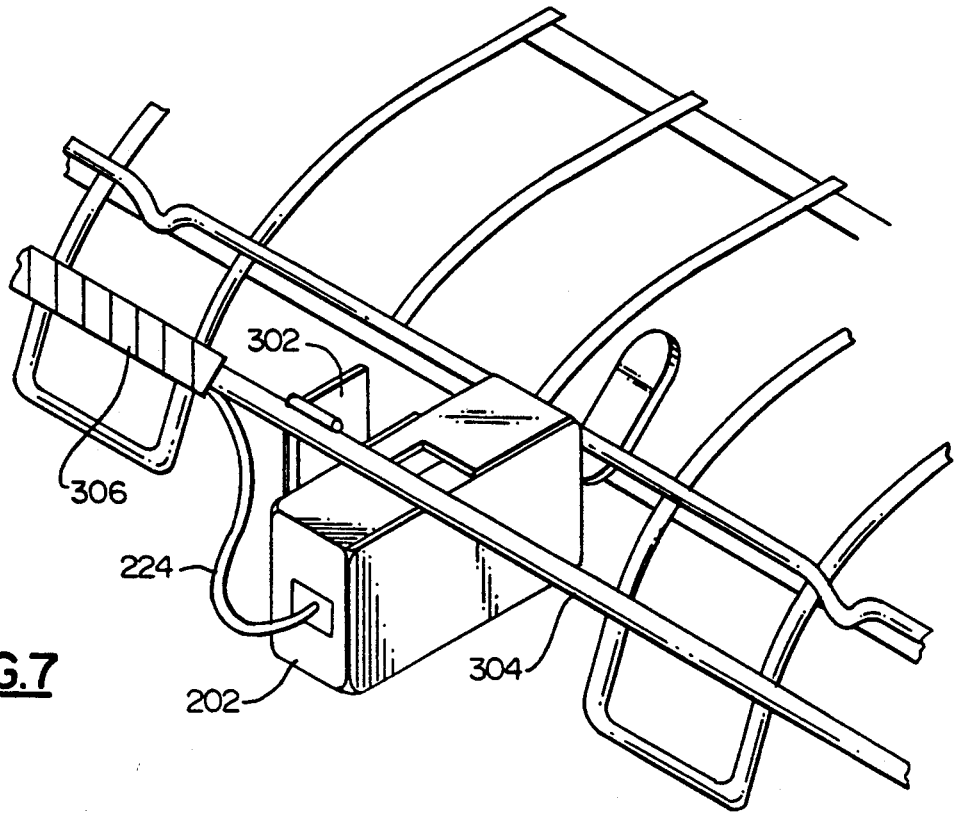
FIG. 7 is an enlargement of the portion of FIG. 6 showing the misfold detector mounted on paper deflecting means.

FIGS. 6 and 7 shows paper misfold detector 180 attached to paper deflecting means 112. Paper deflection means 112 includes a welded wire grid frame attachable to the printer. A bracket 302 is welded to wire 304, and base 202 is bolted (not shown) to bracket 302. Cable 224 is routed through spiral plastic wrapping 306 to the edge of the frame at 308 wrapping 366 prevents interaction between the paper and the cable. Plug 222 is in position to connect into a receptacle (not shown) into the printer. The detector is positioned laterally in relation to length 106 of paper to be in communication with any misfolding paper for any common form width.

Figure 8:
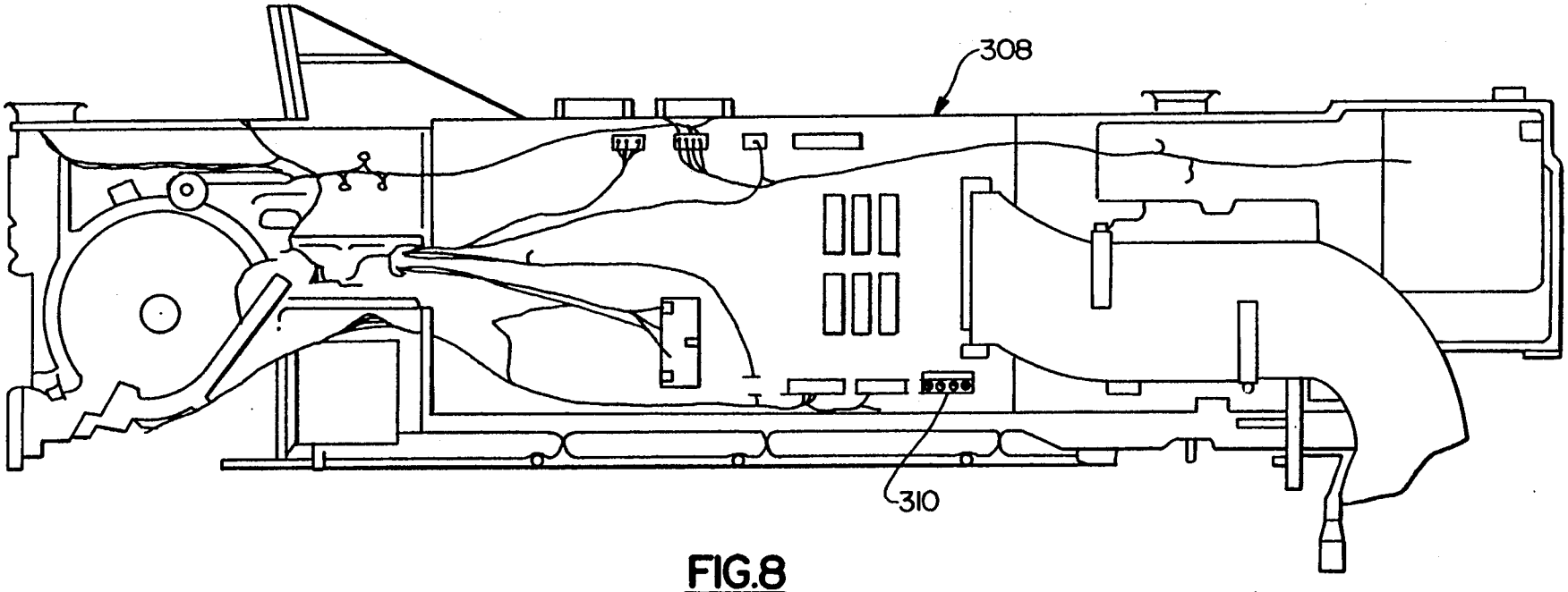
FIG. 8 is a view of the circuit board of the printer into which a cable delivers signals from the misfold detector switch.

FIG. 8 shows circuit board 308 with a connector 310 of 4 in-line protruding pins with which the misfold detector communicates to stop the printing if misfold is detected for preventing damage to the paper, jamming of paper movement, loss of data and complex procedures to restart printing.

Figure 9:
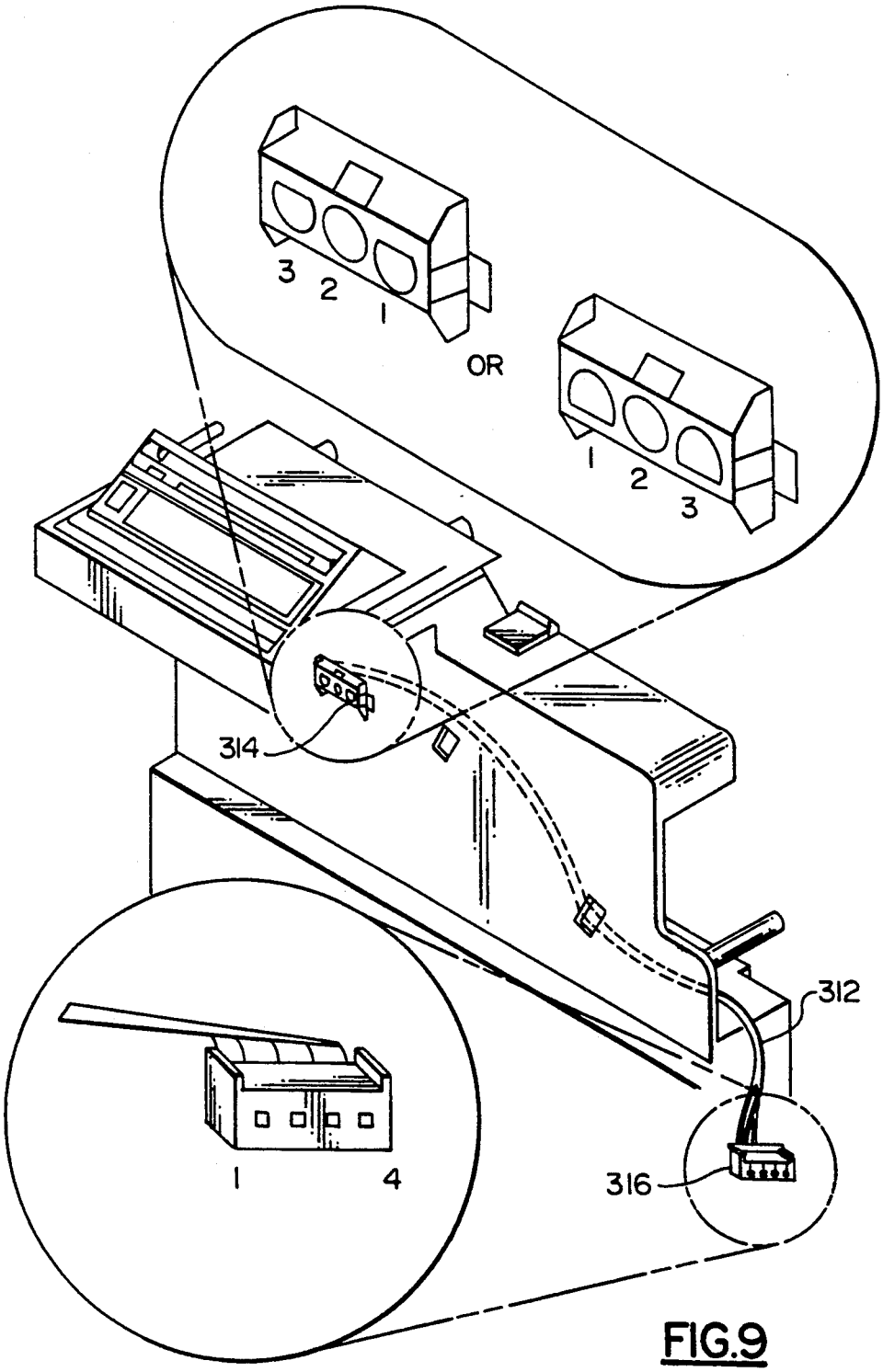
FIG. 9 shows the routing of a cable from the printer output area to the circuit board of FIG. 8 for delivery of misfold detector signals.

FIG. 9 shows the routing of connecting cable 312 between socket 314 into which plug 228 (see FIG. 2) is inserted and plug 316 which connects to the four in-line pins of circuit board 308 of FIG. 8. Socket or cap 314 is preferably a 4 circuit in-line cap such as shown at page 8 in AMP Catalog 87-803.

While the currently preferred embodiment of this invention has been illustrated and described, various changes and modifications may be made therein within the scope of this invention which is defined by the following claims.

What is claimed is:

1. A continuous-forms printer comprising in combination:

means for supplying a length of continuous form paper which is prefolded laterally along linear perforations which connect between sheets;

printing means for producing images on the surface of the length of paper;

tractor means for moving the length of paper longitudinally through the printing means and downward onto a fanfold output stack after printing;

surface means for stacking the perforation connected paper sheets thereon in a fanfold arrangement up to a maximum operating stack height;

means for directing the paper from tractor means downward toward surface means;

a misfold detector positioned at said paper directing means for detecting misfolds between the tractor drives and directing means and for detecting misfolds between the directing means and output stack.

2. The printer of claim 1 in which the misfold detector includes:

a lever which activates the detector if pushed in either of two opposite directions for detecting misfolding paper for detecting misfolds between the tractor drives and directing means and for detecting misfolds between the directing means and output stack.

3. The printer of claim 2 in which the misfold detector further includes:

a base for positioning parts of the misfold detector therein;

a light sensor positioned in the base to detect a beam of light;

a light emitter positioned in the base to direct a beam of light toward the light sensor;

an opaque plate positioned in the base to which the lever is attached which is free to rock about an axle within limits defined by the base, and which includes a window section at one end which is transparent to light, and which is positioned so that in a neutral position the beam of light is directed through the window and if rocked in either direction obstructs the beam of light;

a spring bar for biassing the plate to be in the neutral position when no force is applied to the lever;

a cover which together with the base encloses and protects parts of the detector.

4. A continuous-forms printer comprising in combination:

means for supplying a length of continuous form paper which is prefolded laterally along linear perforations which connect between sheets;

printing means for producing images on the surface of the length of paper;

tractor means for moving the length of paper longitudinally through the printing means and downward onto a fanfold output stack after printing;

surface means for stacking the perforation connected paper sheets thereon in a fanfold arrangement;

means for directing the paper from tractor means downward toward surface means;

means for connecting a misfold detector at paper directing means including a receptacle for the plug connection of a cable for transmitting misfold detection signals for stopping printing when misfolding is detected.

5. The printer of claim 4 in which the receptacle is near said paper directing means; and the printer further comprises:

a circuit board for controlling printer operation; and a cable connecting between the receptacle and the circuit board.

6. A continuous-forms printer comprising in combination:

means for supplying a length of continuous form paper which is prefolded laterally along-linear perforations which connect between sheets;

printing means for producing images on the surface of the length of paper;

tractor means for moving the length of paper longitudinally through the printing means and downward onto a fanfold output stack after printing;

surface means for stacking the perforation connected paper sheets thereon in a fanfold arrangement up to a maximum operating stack height;

means for directing the paper from tractor means downward toward surface means;

a misfold detector including:

a lever which activates the detector if pushed in either of two opposite directions for detecting misfolding paper for detecting misfolds between the tractor drives and directing means and for detecting misfolds between the directing means and output stack.

* * * * *